US007673595B2

(12) United States Patent
Pelov

(10) Patent No.: US 7,673,595 B2
(45) Date of Patent: Mar. 9, 2010

(54) ROTOR-PISTON INTERNAL COMBUSTION ENGINE

(75) Inventor: Ivaylo Sachariev Pelov, Pleven (BG)

(73) Assignee: Pelanel GBR, Kolm (DE)

( * ) Notice: Subject to any disclaimer, the term of this patent is extended or adjusted under 35 U.S.C. 154(b) by 47 days.

(21) Appl. No.: 11/884,056

(22) PCT Filed: Jan. 16, 2006

(86) PCT No.: PCT/EP2006/000312

§ 371 (c)(1),
(2), (4) Date: Aug. 8, 2007

(87) PCT Pub. No.: WO2006/084542

PCT Pub. Date: Aug. 17, 2006

(65) Prior Publication Data

US 2008/0121207 A1 May 29, 2008

(30) Foreign Application Priority Data

Feb. 8, 2005 (EP) ..... 05002570

(51) Int. Cl.
*F02B 57/08* (2006.01)

(52) U.S. Cl. ..... 123/44 D; 123/43 R; 123/45 R

(58) Field of Classification Search ..... 123/43 R, 123/44 D, 45 R; 60/39.44
See application file for complete search history.

(56) References Cited

U.S. PATENT DOCUMENTS 975,485 A * 11/1910 Waltman ..... 123/43 R
1,042,675 A * 10/1912 Helmes ..... 123/44 D
2,127,016 A * 8/1938 Voiles ..... 123/226
3,581,718 A * 6/1971 Petty ..... 123/44 D
3,665,811 A * 5/1972 Van Avermaete ..... 123/44 D
3,857,371 A * 12/1974 Gibson ..... 123/44 D
3,865,093 A * 2/1975 Ferragut Rodriguez ... 123/44 D
4,166,438 A * 9/1979 Gottschalk ..... 123/43 R
5,123,394 A * 6/1992 Ogren ..... 123/44 D
5,365,892 A * 11/1994 Kienle ..... 123/44 D
6,062,175 A * 5/2000 Huang ..... 123/43 R
6,253,717 B1 * 7/2001 Doyle ..... 123/44 D

FOREIGN PATENT DOCUMENTS

| | | | |
|---|---|---|---|
| CA | 2300584 | | 10/2000 |
| DE | 3531208 | A1 * | 2/1986 |
| DE | 4118938 | A1 * | 12/1992 |
| FR | 1600757 | * | 9/1970 |
| FR | 2750162 | | 12/1997 |
| GB | 357979 | | 9/1931 |

* cited by examiner

*Primary Examiner*—Thomas E Denion
*Assistant Examiner*—Mary A Davis
(74) *Attorney, Agent, or Firm*—Andrew Wilford

(57) ABSTRACT

The invention relates to an internal combustion engine comprising a rotor which is mounted in such a way that it can be rotated about a central axis in a housing, and in which cylinders are arranged in the same plane, pistons being introduced into said cylinders, the inner end of said pistons being connected to an eccentrically arranged axis in an articulated manner. The cylinders are rotatably mounted in the outer edge of the rotor respectively with the outer ends thereof, and end in the outer envelope of the rotor. At least one combustion chamber is arranged in the housing, the inner end of the chamber ending in the inner housing wall that surrounds the outer envelope of the rotor. The combustion chamber is arranged at an angle of between 45 and 90 degrees, especially between 70 and 85 degrees, to the radius of the rotor.

18 Claims, 10 Drawing Sheets

E - E

ROTOR-PISTON INTERNAL COMBUSTION ENGINE

Figure 1:
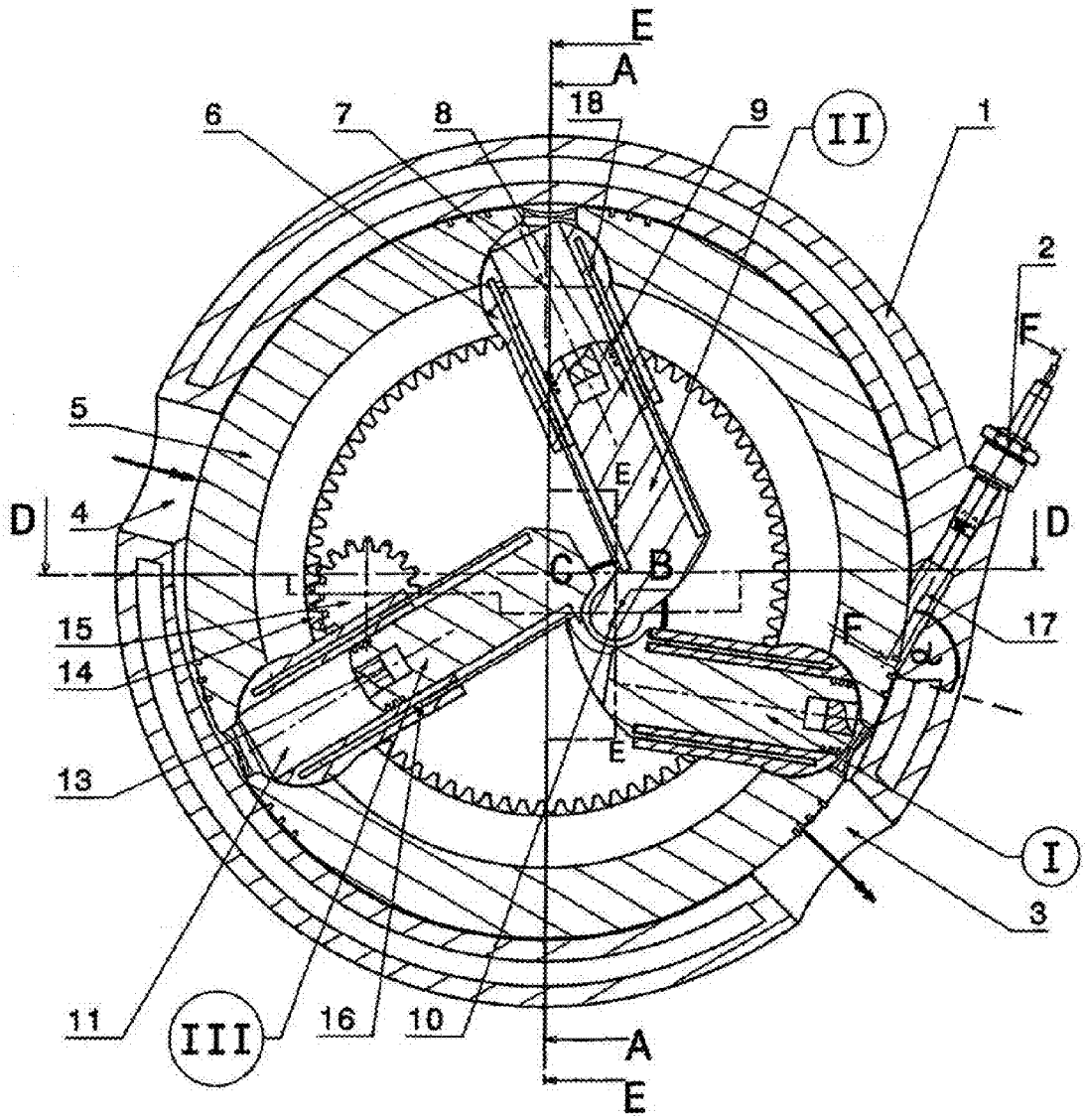

The invention relates to an internal combustion engine as per the preamble of claim 1.

Radial engines are known in which the cylinders with pistons are arranged in a star shape and the piston rods drive a crankshaft. A special type of radial engine is the rotary engine in which the crankshaft is stationary and the cylinders with pistons rotate.

Also known are rotary engines such as the Wankel engine in which a rotor rotates in an elliptical housing with epitrochoidal chambers, which rotor follows the ellipsoidal shape. As the rotor moves, the volumes of the individual chambers vary, and the four strokes of the engine are carried out during one rotation of the rotor, with sub-optimal segmentation. The elliptical shape generates differences in the chamber volumes, and the four working strokes thereby take place. The engines, and conventional internal combustion engines with pistons, have in common the fact that the combustion in the cylinder moves the piston, with the drive force being generated in this way.

It is an object of the invention to provide an internal combustion engine which, with a simple construction and smooth running behavior, has a high degree of efficiency. It is also an object of the invention to avoid the elliptical shape with the aim of maximum chamber sealing, reducing vibrations to a minimum and simplifying construction.

The objects are achieved according to the invention by means of the characterizing part of claim 1.

New features here are inter alia that the combustion of the air/gas mixture no longer takes place directly in the cylinders, and therefore the pistons no longer serve to provide drive directly, but the cylinders with pistons supply the additional combustion chambers with the compressed air/gas mixture. The rotor is driven by the gas flowing out of the combustion chamber, which is situated outside the rotor, after ignition.

As a result of the separation of compression and combustion, efficiency is increased, vibrations are reduced and wear is reduced. The compression and combustion processes can be optimized in separate regions of the engine.

The rotary-piston internal-combustion engine is distinguished in that it has small external dimensions, is light in weight and yet is highly powerful and nevertheless is economical, offers a wide spectrum for the control of the engine power, has a low fuel consumption and can burn fuels with a relatively high ignition point, such as for example hydrogen.

Further advantageous embodiments of the invention are listed in the subclaims.

According to the invention, the rotary-piston engine has a circular shape of the rotor and is constructed with an axis which is offset from the center C. This eliminates the complicated elliptical movement and permits good sealing of the individual working chambers.

The intake, compression and ignition of the air/fuel mixture and the discharge of the exhaust gases are carried out by means of the difference in the distances of the axis, which is offset from the center (C) of the rotor at the point B (center B), of the piston group to the periphery of the rotor. The intake takes place in the sector of maximum radius (r max) and the ignition of the air/fuel mixture and the discharge of the exhaust gases are carried out in the sector of minimum radius (r min) in one rotation of the rotor. The force generated as a result of the ignition is aligned tangentially in the direction of rotation of the rotor, which direction of rotation is predefined by the combustion chamber, the piston group and the offset center (B).

Figure 2:
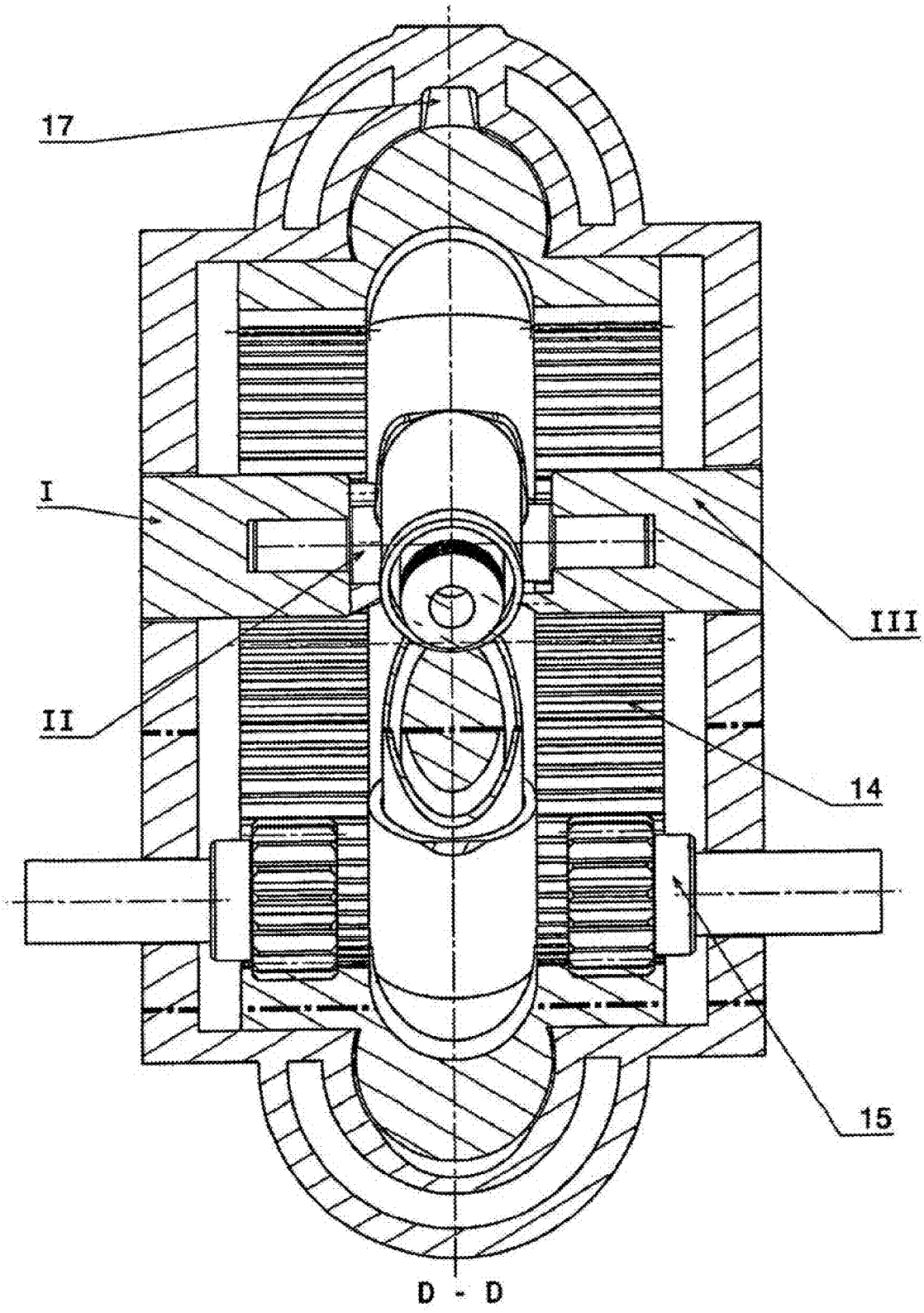
Figure 3:
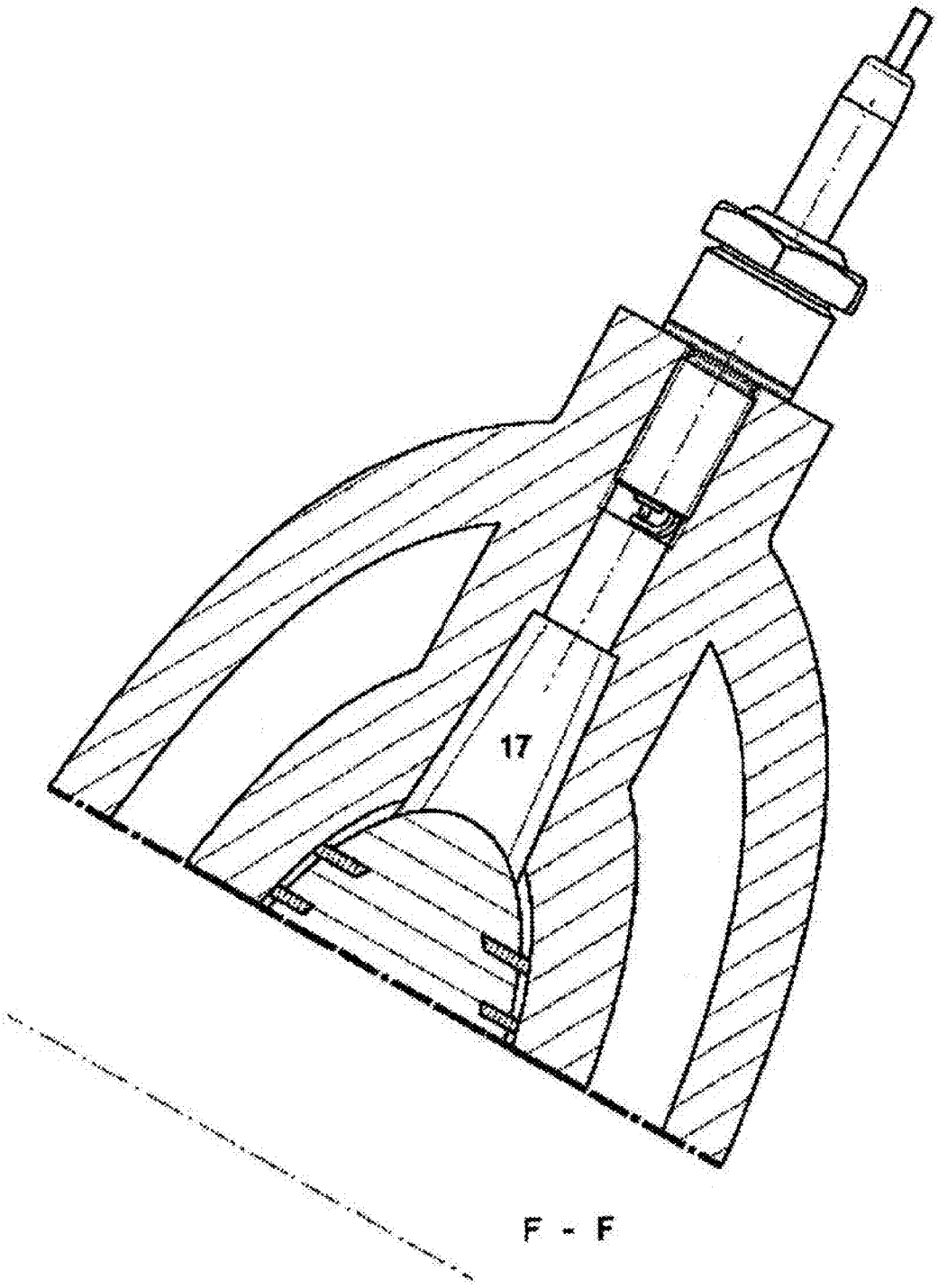
Figure 4:
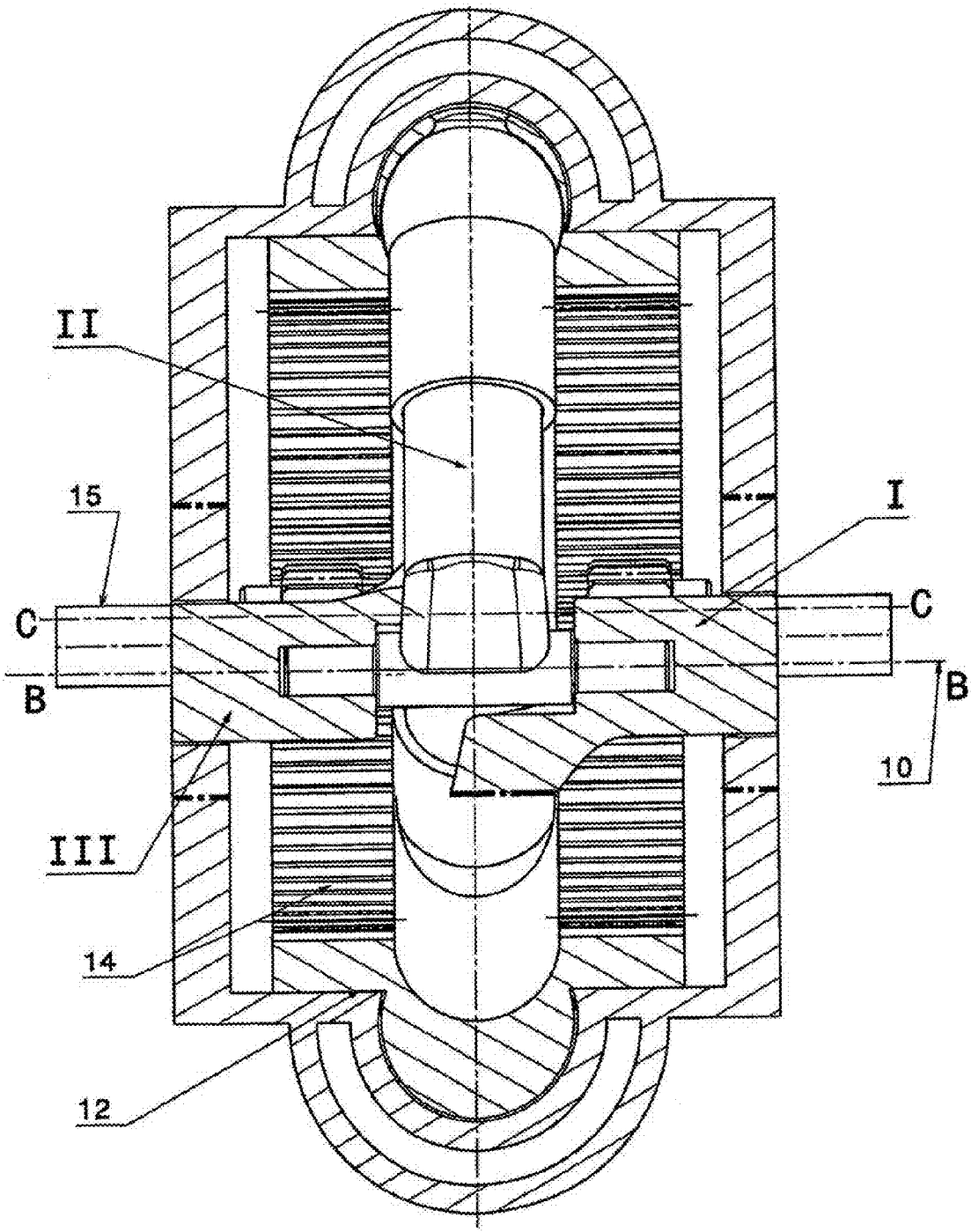
Figure 5:
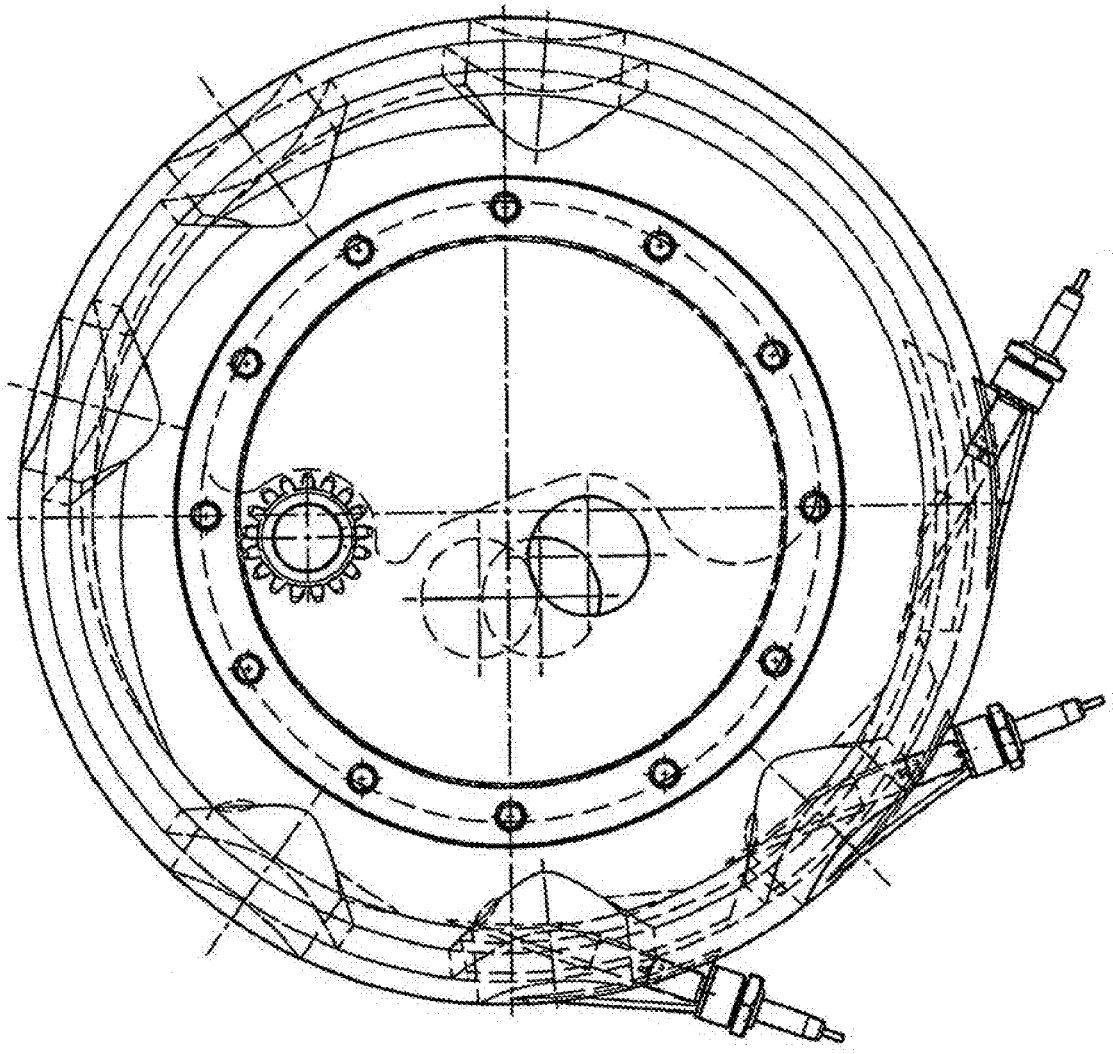
Figure 6:
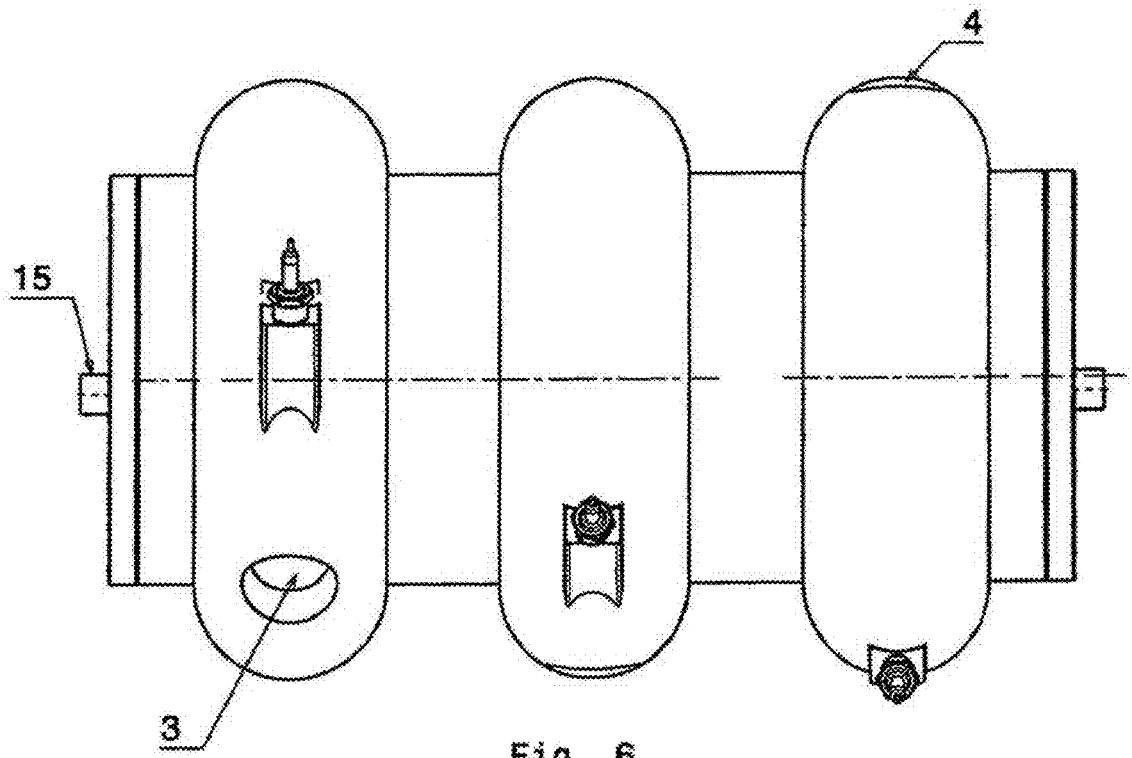
Figure 7:
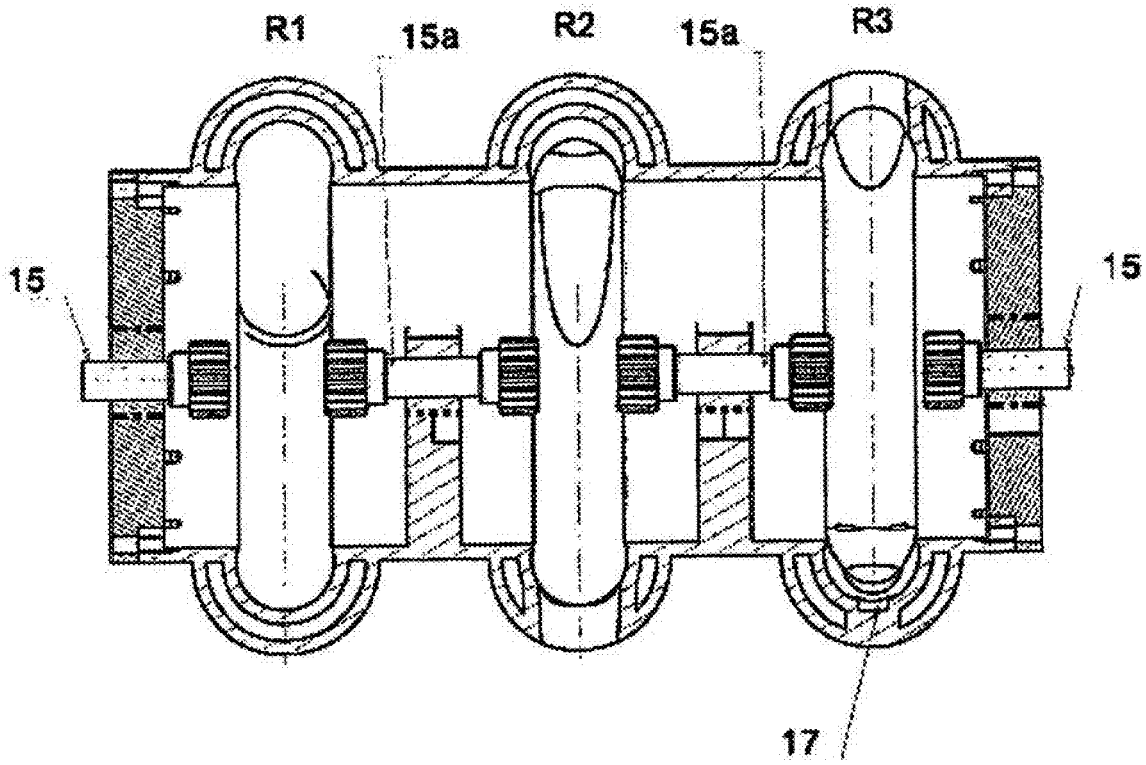
Figure 8:
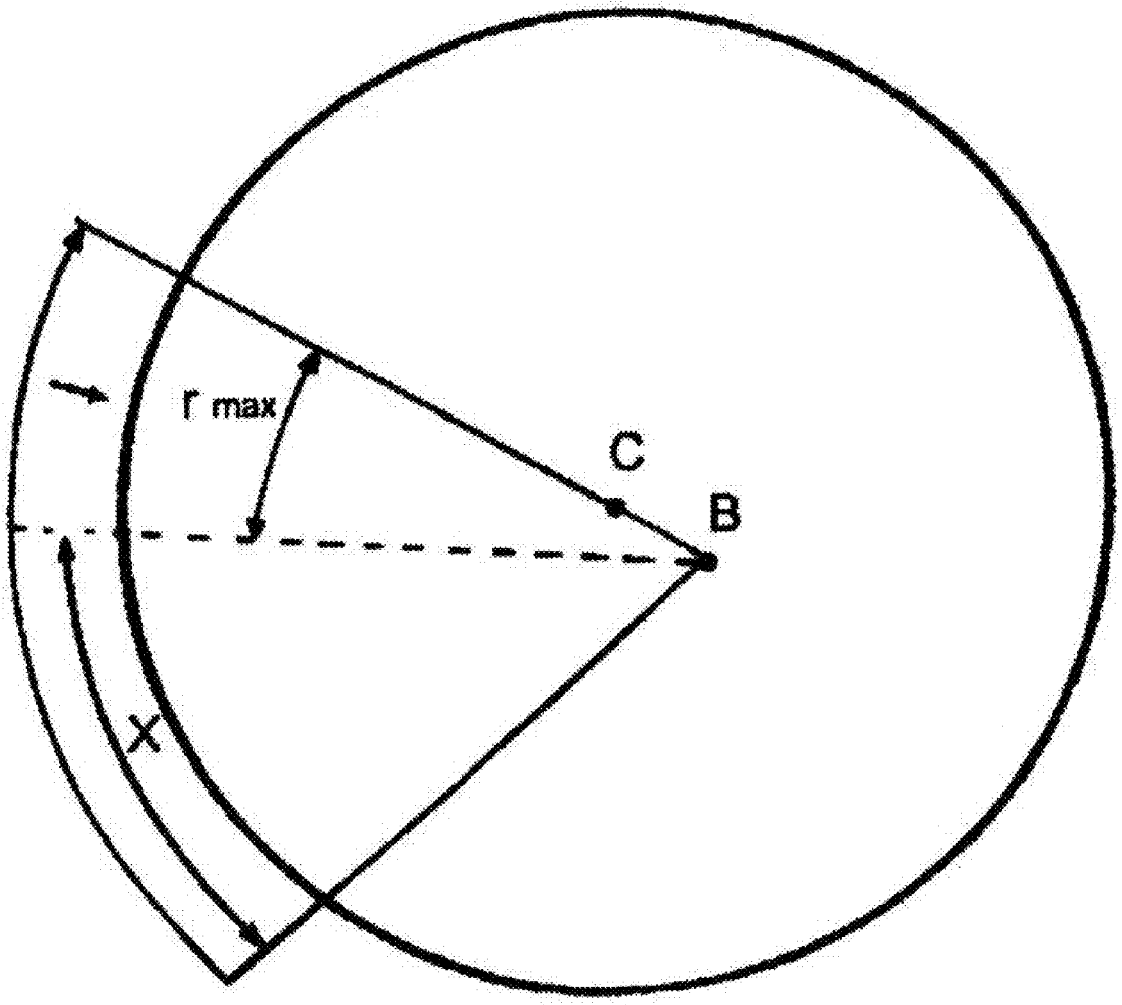
Figure 9:
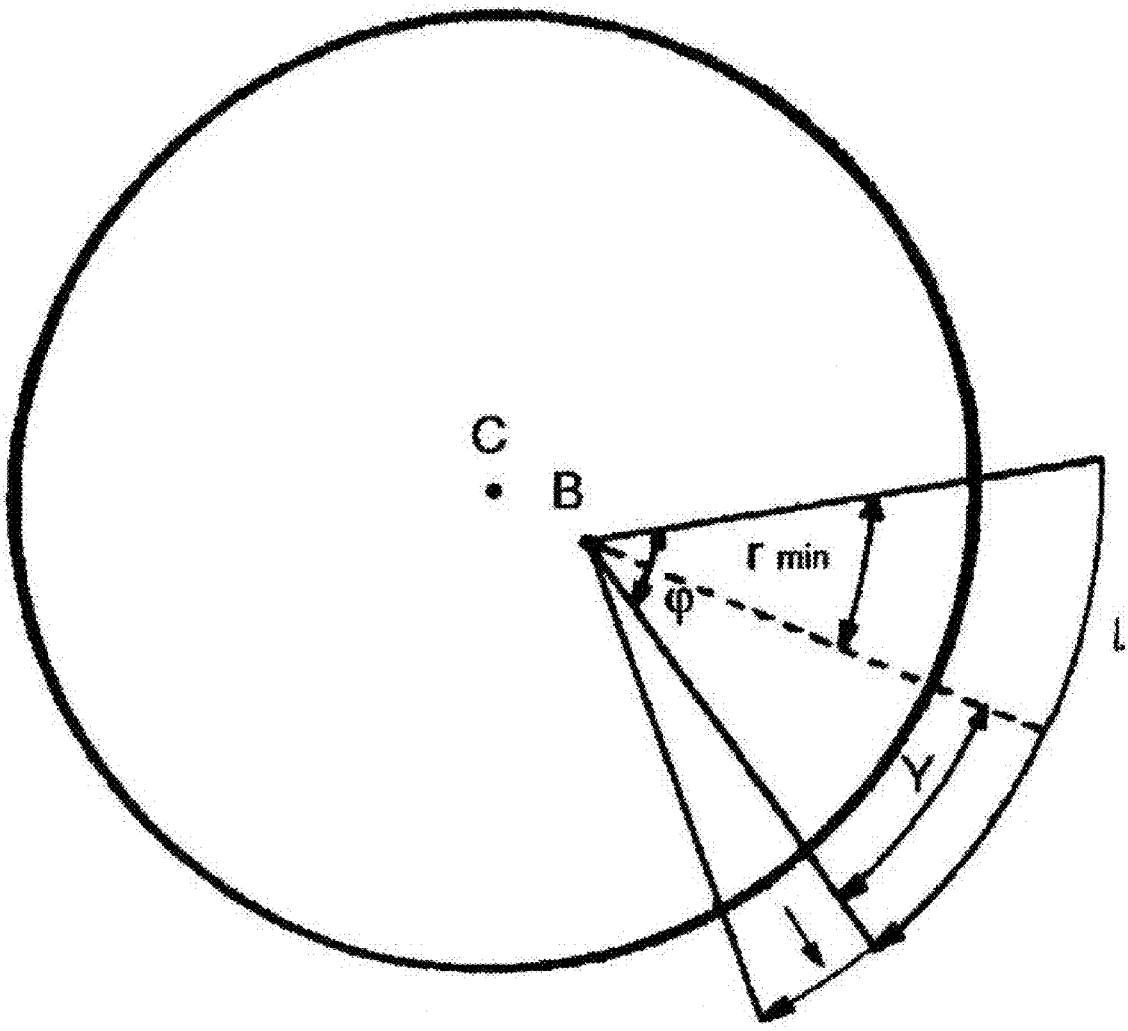
Figure 10:
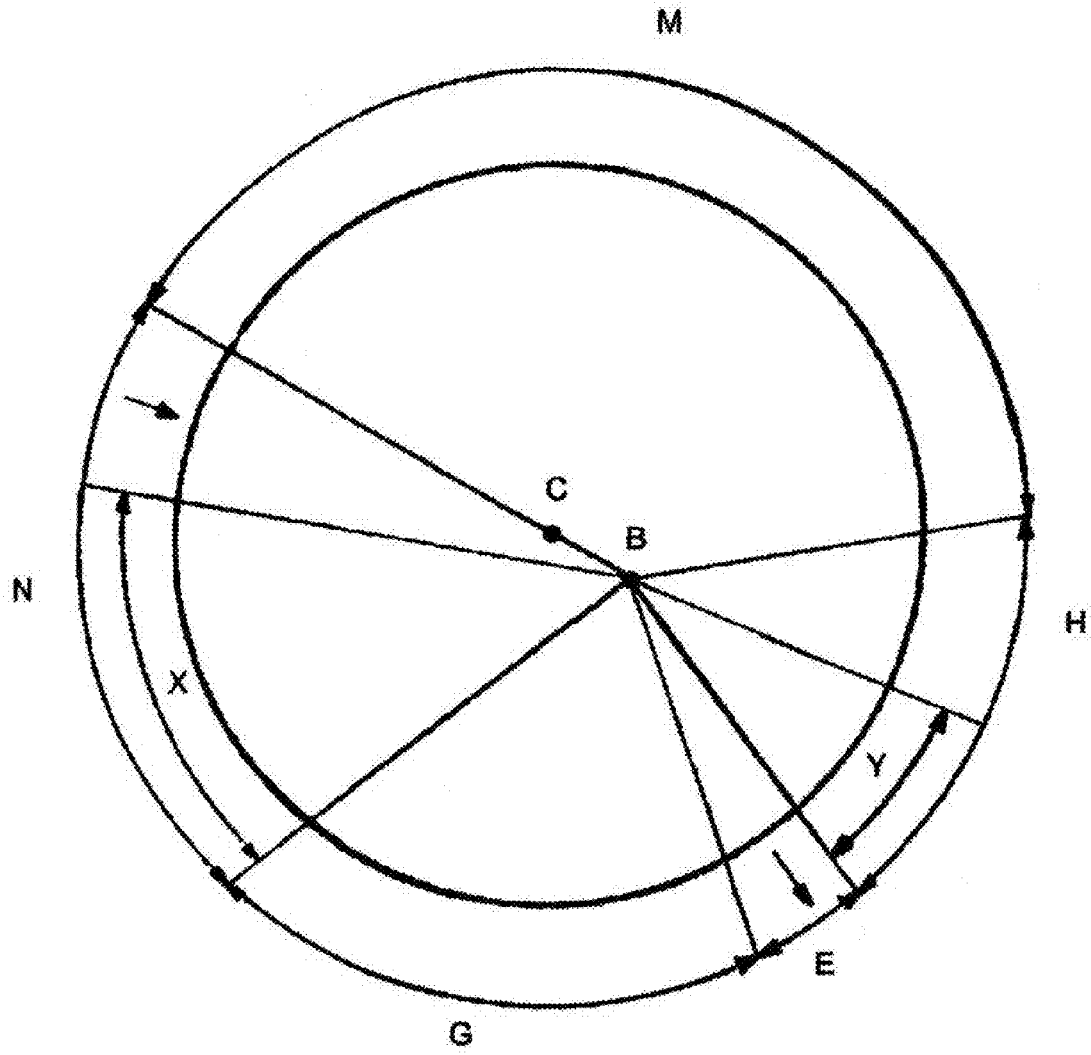

Advantageous exemplary embodiments of the invention are illustrated in the drawings and are described in more detail in the following. In the drawings:

FIG. 1 shows a cross section of the rotary-piston internal combustion engine, FIG. 2 shows a section according to D-D in FIG. 1—one of the variants for mounting the piston group, FIG. 3 shows a section according to F-F in FIG. 1, FIG. 4 shows a section according to E-E in FIG. 1, FIG. 5 shows an end view of the engine, FIG. 6 shows a view of the engine from above, FIG. 7 is an illustration of the toothing between the individual rotors (R1, R2, R3) in the engine, FIG. 8 is a schematic illustration of the process of the intake of the air/fuel mixture and of the controllable sector (X) which determines the starting instant thereof, FIG. 9 is a schematic illustration of the working process and of the controllable sector (Y) which determines the starting instant of the discharge of the exhaust gases, FIG. 10 shows a circle diagram of the intake (N), compression (M), working (H), exhaust gas discharge (E) and vacuum generation (G) processes.

In the figures, identical parts are fundamentally provided with the same reference symbols.

The rotary-piston internal combustion engine, composed of three or more interacting, liquid-cooled housings 1 which are arranged parallel to one another, has—according to FIGS. 1 to 3—in each case one housing 1 to which are attached a spark plug 2, and exhaust gas opening 3 and an intake opening 4. In the housing 1, the rotor 5 is formed with two ring gears 14. The segments 9 are attached to the rotor 5 at both sides of each individual working chamber 11 of the cylinders 6, which segments 9 serve to seal the working chambers 11. Those parts of the cylinders 6 which are moveably held in the rotor 5 are spherical at the outside, thereby performing the function of a ball joint.

The cylinders 6 are radially moveable and orbitally traversing and slide on the pistons 8 which are provided with smaller pistons (13) (expanders) and are themselves sealed off by the segments 9. The pistons 8 are mounted axially so as to be moveable independently of one another, as shown in FIG. 2. The pistons 8/I and 8/III are mounted in the housing 1 and the piston 8/II is mounted between and in pistons 8/ and 8/III. The mounting of the piston group 8/I+II+III is offset from the center C of the rotor 5 at point B (offset center B, intersected by the axis 10). The pistons 8 are axially immovable relative to the center B and do not traverse orbitally. Toothed gearings 15*a* mesh with the ring gears 14 at both sides of each rotor 5, and output shafts 15 extend out from the end housings R1 and R3 (see FIG. 7). The movement proceeds from the periphery of the rotor 5 and not from its center. The volumes of the working chambers 11 and the power of the engine are determined by the diameter of the pistons 8, the diameter of the rotor 5 and the axis 10 which is offset from the center C of the rotor 5.

Top dead center of each piston is reached in the region where the discharge of the exhaust gases begins (FIG. 1). The straight line which passes through the center C of the rotor and through the offset center B shows precisely this region. The combustion chamber 17 is situated before the exhaust gas opening at an angular spacing of 30° from precisely the straight line. At the point of ignition of the air/fuel mixture in the combustion chamber 17, the piston 8 has not yet fully reached top dead center.

The cylinders 6 which are moveably held in the rotor 5 in the manner of balls act as compensating arms (angular compensators) which compensate the angled transitions to the different orbital positions which are determined by the offset center B and the circular shape of the rotor 5.

A smaller piston 13 is provided in the working chamber 11 of each cylinder 6, which smaller piston 13 serves to compensate the different loading torques at the different predefined powers up to the time at which the exhaust gases are discharged. The smaller piston 13 does not have any influence on the indicated pressure (pressure) formed in the working chamber 11. The movement is transmitted tangentially by means of pressure on the rotor 5 in its movement direction. The movement direction is predefined by the structure of the combustion chamber 17 in the housing 1 and by the piston group which is offset from the center C of the rotor 5 and is mounted in the housing 1, FIG. 2 (axis 10).

The cylinder path (working volume) is varied, and the power of the engine during its working cycle can be varied as a result, with a change in the position of the offset center B from point B to another point (this can be controlled automatically). As can be seen in FIGS. 1 and 9, the spacing from the combustion chamber 17 to the discharge opening 3, represented by curve l, can be varied in sector Y; the adjustment influences and determines the working process ($A=F \cos \phi$) and the starting instant of the discharge of the exhaust gases. In the sector (r max), the intake opening 4 is structurally predefined such that, by means of its selectable positioning in the sector X, the starting instant of the intake of the air/fuel mixture can be varied.

$A=F \cos \phi$ $\phi=\omega t$ $F=\phi t$ $f=r\phi$

A=Work

F=Force $\omega$=Angular speed $\phi$=Rotational angle t=Time l=the curve (path) from the combustion chamber 17 to the discharge opening 3

Z=Transmission number

For a constant volume of the working chamber 11 during the working process H, the present invention provides the desired indicated pressure, which corresponds to the predefined force F which acts on the rotational angle $\phi$ for a certain time t, with a significantly lower fuel quantity.

The function of the engine is provided once the starter is activated and the rotor 5 rotates. As a result of the structural differences in the distance from the periphery of the is rotor 5 to the axis 10 which is offset from the center C, the cylinders 6 vary the volumes of the working chambers 11 and, as a function of their contact points, the five working processes (see FIG. 10) are carried out during one rotation of the rotor 5. In the ignition process at the position of the piston (8/I, see FIG. 1), the working chamber 11 and the combustion chamber 17 in the housing 1 meet. At this instant, the air/fuel mixture is compressed to a maximum degree in the working chamber 11. When the latter meets the combustion chamber 17, the air/fuel mixture is compressed into the combustion chamber 17 and is immediately ignited. After ignition, the generated force F acts on the piston head 8/I or on the rotor 5. As a result, the force F is distributed tangentially to the rotor 5 in its movement direction and acts up to the time of discharge of the exhaust gases through the adjustable discharge opening 3. The working chambers 11 in the rotor 5 are positioned with an angular spacing of 120° relative to one another. As a result, the ignition process takes place three times (with angular spacings of 120°) in one rotation of the rotor 5. The process takes place separately in each of the three housings 1/R1, R2, R3 of the engine.

As mentioned in the introduction (see FIG. 6), the complete engine is composed of three or more housings 1/R1, R2, R3 which mesh with one another by means of toothed gearings 15*a* and work synchronously. The piston group 8 of each subsequent housing 1 is offset in relation to the preceding one by a certain angle which corresponds proportionately to the number of housings 1 in the engine. In the case of three housings 1, each subsequent piston group 8 is positioned so as to be offset in relation to the preceding one by 40°. The combination of different housing diameters in the engine permits different power values per individual rotor 5. The construction makes it possible, depending on the requirements and the situation, to automatically select the number of housings 1 which are taking part in the driving operation of the engine. Reduced fuel consumption is achieved in this way. At high power demands, all three housings 1, R1, R2, R3 take part in the driving operation of the engine.

The annular piston 16 serves to carry out the intake of air in the sector of maximum radius (r max, see FIG. 8), and to compress the air in the sector of minimum radius (r rain, see FIG. 9). The air enters into zones, in which it serves to provide additional cooling, through ducts in the cylinders 6 and in the rotor 5 at certain contact points which correspond to ducts of the type in the housing 1. The compressed air cools the spark plug 2 and the combustion chamber 17 in the housing 1 and assists the discharge of the exhaust gases. The annular pistons 16 arranged radially in the cylinders 6 form a compressor. If required, the air can be utilized (used) for additional compression of the air/fuel mixture.

At standstill, the rotor 5 has a certain structural mass which has a lower overall value than during rotation. The space from the inside of the rotor 5 is filled once with oil. The rotation causes centrifugal forces which distribute the oil on the inner wall of the rotor 5.

The rotor 5 has a structurally predefined relief shape of the inner wall. This causes the vaporization of the oil back into the interior space of the engine. As a result, a new, higher value of the mass of the rotor 5 is generated during rotation. This permits a relatively low level of energy consumption as the engine is started and a relatively high torque during working operation of the engine.

The invention relates to internal combustion engines of the rotary-piston type and can be used in automobile, aircraft and ship construction for driving wheels, generators, pumps and for driving various-gearings and mechanisms.

Once the rotary-piston engine is started, the rotor 5 is set into a right-hand rotational movement, with the volume of the working chamber 11 remaining constant during the working process (ignition of the air/fuel mixture in the combustion chamber 17).

At the instant, the piston 8 does not carry out any retracting movement. The pistons 8 serve only to suck air/fuel mixture into the cylinders 6, to compress the air/fuel mixture into the combustion chamber 17 and to discharge exhaust gases. Each individual piston 8 is mounted independently of the others. The entire piston group rotates about the axis 10 which is offset from the center C.

The ignition of the air/fuel mixture takes place outside the working chambers 11, specifically in the combustion chamber 17. At the instant, the piston 8 which has compressed the air/fuel mixture into the combustion chamber 17 forms an angle of 70° in relation to the rotor. The force F generated during the detonation is directly distributed tangentially to the rotor 5 by means of pressure. The piston 8 is not set into a retracting motion as a result of the detonation, as can be seen from FIGS. 1 and 3. Each individual piston 8 has a smaller piston 13 which absorbs a part of the detonation force F at the first instant and thereby makes it possible to equalize (compensate) the different intensities of detonations in the event of a change in position of the discharge opening 3, of the intake opening 4 or of the center B. The smaller piston therefore protects the combustion chamber 17 and also the housing 1 against overloading.

The rotary-piston internal combustion engine is composed of 3 rotors 5 and 3 piston groups 8/1, 8/II, 8/111 with the associated cylinders 6, in total 9 pistons 8. Each piston 8 is positioned in a structurally predefined fashion in relation to the others in such a way that an angle of 40° is formed between the pistons 8. This means that, as the engine is started, ignitions are carried out at intervals of 40°. The angular spacing is correspondingly proportionally reduced, in the possible case of a design of the engine with 4 rotors 5, to 30° (for example: in the case of 5 rotors 5, to 24°).

High rotational speeds are obtained at the output shaft 15, which meshes directly with the rotor 5 at its periphery, at a low rotational torque of the engine; this is possible without any complicated designs such as for example step-down gearings.

It is finally to be stated that, by means of the invention, a rotary-piston internal combustion engine has been developed which, in contrast to a Wankel engine, does not carry out any elliptical movement, and also has structural advantages over the Wankel engine, including: optimum sealing of the working chambers 11; low energy consumption when starting the engine; lighter in weight and more powerful during operation; small engine size; good dynamic equalization; economical; automatic user-oriented control of the engine power according to requirements, and therefore fuel consumption which can be selected depending on the situation; capable of burning fuels with a relatively high detonation point, such as hydrogen.

The invention claimed is:

1. In an internal combustion engine having an annular rotor rotatable in a direction about a central axis in a housing and in which cylinders are arranged in a common plane and hold respective main pistons reciprocable along respective piston axes and having respective inner ends pivoted on an eccentric axis, the improvement wherein the cylinders have outer ends pivoted in an outer casing of the rotor, the cylinders open radially outward through the outer casing of the rotor and each form a working chamber with the respective main piston, a combustion chamber formed in the housing has an inner end opening radially inward on an inner housing surface surrounding the outer casing of the rotor, each main piston has a respective smaller secondary piston shiftable along the respective piston axis and exposed in the respective working chamber, and the combustion chamber extends at an angle of 70 to 85 degrees relative to a radius from the central axis.

2. The internal combustion engine as claimed in claim 1 wherein there are three of the cylinders with respective pistons in the rotor at an angular spacing of 120 degrees.

3. The internal combustion engine as claimed in claim 1 wherein the housing has an exhaust gas port and an intake opening, the exhaust gas port being located downstream of the intake opening in the rotational direction of the rotor.

4. The internal combustion engine defined in claim 1 wherein the annular rotor has internal teeth in which a drive output pinion engages.

5. The internal combustion engine defined in claim 1 wherein the rotor casing is formed with respective passages opening into the cylinders for gas expanding in the combustion chamber.

6. The internal combustion engine defined in claim 1 wherein the housing comprises an annular housing disk on which are arranged the rotor, the cylinder, and the piston, the combustion chamber being formed in a wall of the annular housing disk.

7. The internal combustion engine as claimed in claim 6 wherein there are at least two of the annular housing disks.

8. The internal combustion engine as claimed in claim 7 wherein there are three of the housing disks, the combustion chamber of one housing disk being offset by 40 degrees relative to the combustion chamber of an adjacent housing disk.

9. The internal combustion engine defined in claim 1 wherein the housing is liquid-cooled and there are three of the rotors of circular shape with the same diameter.

10. The internal combustion engine defined in claim 1 wherein the pistons cannot move radially and reciprocate independently from one another about the eccentric axis.

11. The internal combustion engine defined in claim 1 wherein the outer ends of the cylinders which are pivotal in the rotor are spherical and each form a ball joint with the rotor.

12. The internal combustion engine defined in claim 1 wherein the pistons are mounted independently of one another.

13. The internal combustion engine defined in claim 1 wherein the eccentric axis is shiftable radially of the central axis to vary the volume and the compression ratio of the working chambers of the cylinders.

14. The internal combustion engine defined in claim 1 wherein the housing has a plurality of housing sections each holding a respective such rotor each having two respective ring gears connected via respective gear transmissions with the ring gears of adjacent rotors arranged in parallel.

15. The internal combustion engine defined in claim 14 wherein the working chambers of the cylinders of each rotor are positioned with an angular spacing of 120 degrees from one another, so that in adjacent rotors the respective pistons are angularly offset by an angle dependent on the number of rotors.

16. The internal combustion engine defined in claim 1 wherein an oil filling is provided in the housing through which the rotor passes when rotating, so that the rotor has a lower mass at standstill than during its rotation, as a result of oil vaporization on the inside of the rotor caused by the rotation.

17. The internal combustion engine defined in claim 14 wherein an inner wall of the rotor has a structurally predefined relief between the ring gears which permits the vaporization of the oil back into the engine space.

18. The internal combustion engine defined in claim 1 wherein relative to the eccentric axis, the cylinders extend parallel to the respective piston axes.

* * * * *